US011865469B2

(12) United States Patent
Sweeting

(10) Patent No.: US 11,865,469 B2
(45) Date of Patent: Jan. 9, 2024

(54) DOLL PLAYSET

(71) Applicant: Angelica Sweeting, Homestead, FL (US)

(72) Inventor: Angelica Sweeting, Homestead, FL (US)

( * ) Notice: Subject to any disclaimer, the term of this patent is extended or adjusted under 35 U.S.C. 154(b) by 189 days.

(21) Appl. No.: 17/645,567

(22) Filed: Dec. 22, 2021

(65) Prior Publication Data

US 2023/0191267 A1 Jun. 22, 2023

(51) Int. Cl.
*A63H 3/44* (2006.01)

(52) U.S. Cl.
CPC ..... *A63H 3/44* (2013.01)

(58) Field of Classification Search
CPC ..... A63H 3/00; A63H 3/44; A63H 33/046
See application file for complete search history.

(56) References Cited

U.S. PATENT DOCUMENTS 3,225,489 A * 12/1965 Ryan ..... A63H 3/44 446/394
3,955,587 A 5/1976 Dunn et al.
4,070,790 A 1/1978 Strongin et al.
4,674,169 A 6/1987 Katzman
5,041,050 A 8/1991 Elberson
6,527,618 B1 * 3/2003 Faunda ..... A63H 3/44 446/394
7,410,358 B2 * 8/2008 Morehead ..... A63H 3/365 434/94
8,038,501 B2 * 10/2011 Eisen ..... A63H 3/44 446/72
9,211,479 B2 12/2015 Miller
9,314,702 B2 4/2016 Stafford
10,786,747 B2 * 9/2020 Choi ..... A63H 3/44
2010/0077961 A1 4/2010 Lipscomb
2011/0232583 A1 9/2011 Yamin
2011/0300773 A1 * 12/2011 Fong ..... A63H 3/44 446/394
2015/0283471 A1 * 10/2015 Bergemann ..... A63H 3/44 446/394
2016/0288003 A1 * 10/2016 Zwiers ..... A63H 3/48
2021/0127637 A1 5/2021 Citak

* cited by examiner

*Primary Examiner* — John A Ricci
(74) *Attorney, Agent, or Firm* — Emanus, LLC; Willie Jacques

(57) ABSTRACT

A doll playset is disclosed. The doll playset doll playset comprises a doll head and at least one wig cap. The doll head comprises a plurality of indentations located at a plurality of locations on the doll head. The doll head further comprises a first plurality of magnets. Further, each of the first plurality of magnets is coupled to each of the plurality of indentations. The at least one wig cap having a second plurality of magnets. The at least one wig cap is detachably coupled to the doll head by coupling the second plurality of magnets with the first plurality of magnets.

19 Claims, 6 Drawing Sheets

DOLL PLAYSET

FIELD OF THE DISCLOSURE

The present invention generally relates to a playable doll. More particularly, the invention relates to a doll playset with a detachably coupled wig cap, to facilitate a user to use different wigs with a single doll.

BACKGROUND OF THE DISCLOSURE

The subject matter discussed in this background section should not be assumed to be prior art merely as a result of its mention herein. Similarly, any problems mentioned in this background section or associated with the subject matter of this background section should not be assumed to have been previously recognized in the prior art. The subject matter as disclosed in this background section merely represents different approaches related to configuring a detachable wig apparatus on a doll, and more particularly configuring the apparatus on a doll head, wherein such apparatuses themselves may also correspond to implementations of the claimed technology and invention.

People throughout the world collect and play with dolls. Various types of dolls are collected due to multiple reasons, ranging from fine detail and delicate features of the doll to functionality and adornment of the doll, including, for example, speech and change of dressing, respectively. Doll makers may dress dolls with simple outfits or with very extravagant dresses and with hair made from the finest materials. In various aspects, natural facial features are extremely important because they portray the doll in a life-like appearance. Furthermore, the natural appearance of the dolls may be attributed to the amount of detail used in constructing the doll including the doll's facial features, hands, fingers, hair, etc. Based on the user's requirement, more features are added to the dolls, such as the eyes, eyelashes, eyebrows, and the shading of the lips and cheeks.

Unlike wigs or hair-replacements for humans, doll hair possesses different requirements. In a first example, a doll's wig needs to cover and conceal the top of the doll's head. Secondly, dolls are not subject to inclimate weather. Thirdly, human hair-replacements, unlike doll hair, is subject to wear and tear as a result of styling processes such as brushing, combing, and washing. Furthermore, unlike human scalps, the scalps of dolls do not need to breathe. Even further, because the scalps of doll heads do not need to be in contact with air, perspiration and breathing problems do not exist with the hair and scalp of dolls. Because of these differences, doll designers do not look to human hair-replacements to acquire doll wigs or learn new manufacturing designs and techniques.

Prior art, for various aspects contained therewithin, relevant to this disclosure includes U.S. design Pat. No. 6,527,618 to Faunda and U.S. Pat. Publication No 2012/0208428 to Zheng. In each of these prior art references, a doll or a toy with replaceable hair or wigs is disclosed. However, neither of the prior art references presents an ideal solution to the problem of using multiple wigs with a single doll.

In particular, reference '618 to Faunda discloses a doll head and doll wig combination in which the head has a pate. The doll wig includes a thin cap that securely fits to the doll's head. The thin cap includes a substantially translucent polymer material that conforms to the shape of the head of the doll. A plurality of hairs extends from the cap. The spaced relationship of the plurality of hair filaments may show thinning, a balding pattern, or thick hair. An adorned covering for the pate provides a natural skin tone which is seen through the translucent polymer material. The cap may also have a netting portion with an adjustment mechanism to fit a variety of doll head sizes. However, unlike the subject matter of the disclosed invention, Faunda does not disclose the use of magnets to attach the wigs with the doll head. Further, Faunda does not disclose the aspect of using magnets housed in an eco-friendly plastic material to couple the wig to the doll head.

Reference '428 to Zheng discloses a doll assembly with a torso having a neck, at least one arm, and at least one leg. The doll assembly has at least one head having a plurality of faces on different sides of the head, each face having one nose, one mouth, a pair of eyes, and a pair of ears, the head further having a first connector at a bottom portion thereof that removably connects the neck, and a second connector at a top portion thereof. The doll assembly further includes at least one wig having a wig connector that removably connects the second connector to secure the wig to the top portion of the head. However, unlike the subject matter of the disclosed invention, Zheng does not disclose the use of magnets to attach the wigs with the doll head. Further, Zheng does not disclose the aspect of using magnets housed in an eco-friendly plastic material to couple the wig to the doll head.

Given the deficiencies of the prior arts, the need remains for an effective and improved apparatus to quickly and easily couple a flexible and conforming wig to a variably-shaped doll's head which facilitates a user to use a plurality of different wigs with a single doll.

SUMMARY OF THE DISCLOSURE

According to embodiments illustrated herein, a novel, simple and inexpensive doll playset is disclosed. The doll playset comprises a doll head having a plurality of indentations located at a plurality of locations on the doll head. Further, the plurality of indentations is integrated on an outer surface of the doll head. In an exemplary embodiment of the present disclosure, the doll playset comprises a first plurality of magnets wherein each of the first plurality of magnets is coupled to each of the plurality of indentations. Further, the plurality of indentations is located on at least one of a front portion of the doll head, a back portion of the doll head, and a top portion of the doll head. The first plurality of magnets may be adhered into the plurality of indentations using an adhesive or an adhering element or means such as glue, Velcro, solder, etc. Further, the doll playset comprises at least one wig cap having a mesh or net like structure. The at least one wig cap is made of a material selected from a group of washable materials including a soft microfiber polyester, fabric, stretchable material, or a combination of fabrics. Further, the at least one wig cap comprises a second plurality of magnets and the at least one wig cap is detachably coupled to the doll head by coupling the second plurality of magnets with the first plurality of magnets. Further, in an aspect, the first plurality of magnets and the second plurality of magnets may be at least one of neodymium52 (N52) magnets, N40 magnets, and/or N45 magnets. In a further aspect, the first plurality of magnets and the second plurality of magnets facilitate a generally predetermined placement or flexible placement of the wig cap to the doll's head in order to accommodate different size/shape of doll skulls. Further, the use of neodymium magnets eliminates the use of nickel-copper-nickel plating while also preventing rusting of the first plurality of magnets and the second plurality of magnets thereby making the toy suitable for use by children.

In one exemplary embodiment, a doll playset is provided comprising a doll head having a plurality of indentations located at a plurality of locations on the doll head. Further, the plurality of indentations is integrated on an outer surface of the doll head. Even further, the doll playset comprises a first plurality of magnets and each of the first plurality of magnets is coupled to each of the plurality of indentations. Yet further, the plurality of indentations is located on at least one of a front portion of the doll head, a back portion of the doll head, and a top portion of the doll head. The first plurality of magnets may be adhered into the plurality of indentations using an adhesive or an adhering element. Further, the doll playset comprises a wig cap having a mesh structure or net like structure. The wig cap is made of a material selected from a group of washable materials including a soft micro fiber polyester, fabric, stretchable material, or a combination of fabric. In an aspect, the washable material enables the wig cap to be reused more often.

In another exemplary embodiment, the wig cap comprises a plurality of pockets attached to the mesh structure of the wig cap. The plurality of pockets is made of an eco-friendly plastic and configured to accommodate a second plurality of magnets. The eco-friendly plastic eliminates the use of nickel-copper-nickel plating and also prevents rusting of the second plurality of magnets while also aiding in the prevention of childhood chronic diseases, mental retardation, and breast cancer and reproductive health problems.

In an exemplary embodiment, the wig cap is detachably coupled to the doll head by coupling the second plurality of magnets with the first plurality of magnets. Further, the first plurality of magnets and the second plurality of magnets are at least one of neodymium52 (N52) magnets, N40 magnets, and/or N45 magnets. Even further, in another exemplary embodiment the first plurality of magnets and the second plurality of magnets may be of the same shape and size.

Other features and aspects of this disclosure will be apparent from the following description and the accompanying drawings.

BRIEF DESCRIPTION OF THE DRAWINGS

While the specification concludes with claims particularly pointing out and distinctly claiming particular embodiments of the present disclosure, various embodiments of the present disclosure can be more readily understood and appreciated from the following descriptions of various embodiments of the present disclosure when read in conjunction with the accompanying drawings, in which:

DETAILED DESCRIPTION

Figure 1A:
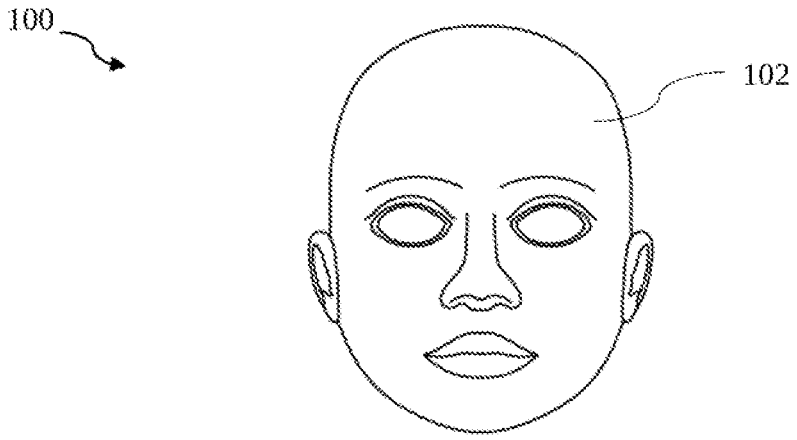
FIG. 1A illustrates a front perspective view of a doll head for a doll playset, according to an embodiment of the present disclosure.
Figure 1B:
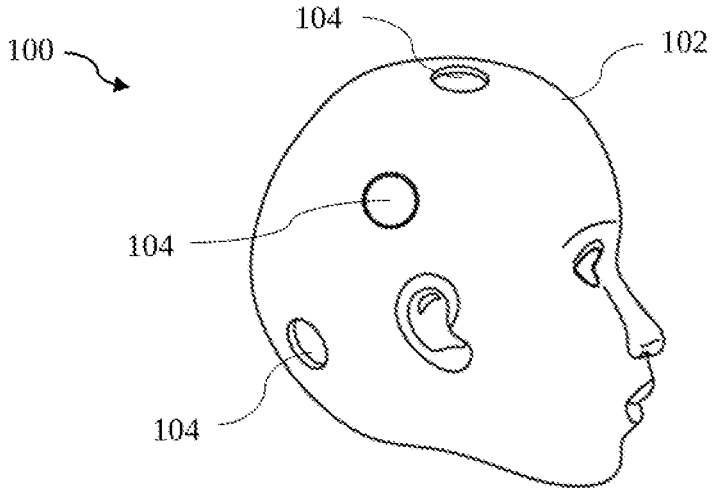
FIG. 1B illustrates a right view of the doll head for the doll playset, according to an embodiment of the present disclosure.
Figure 1C:
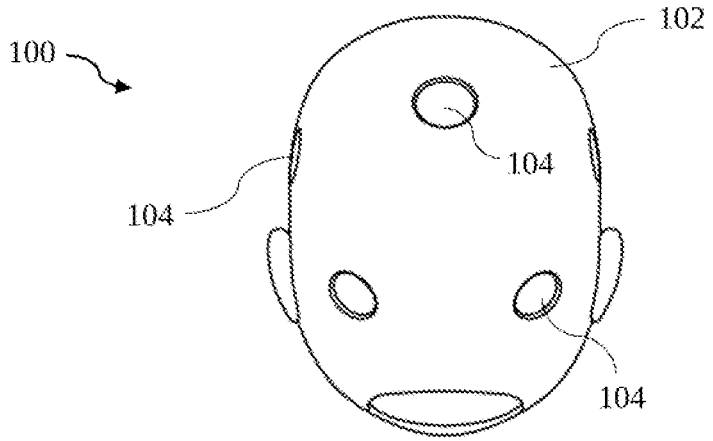
FIG. 1C illustrates a rear view of the doll head for the doll playset, according to an embodiment of the present disclosure.
Figure 1D:
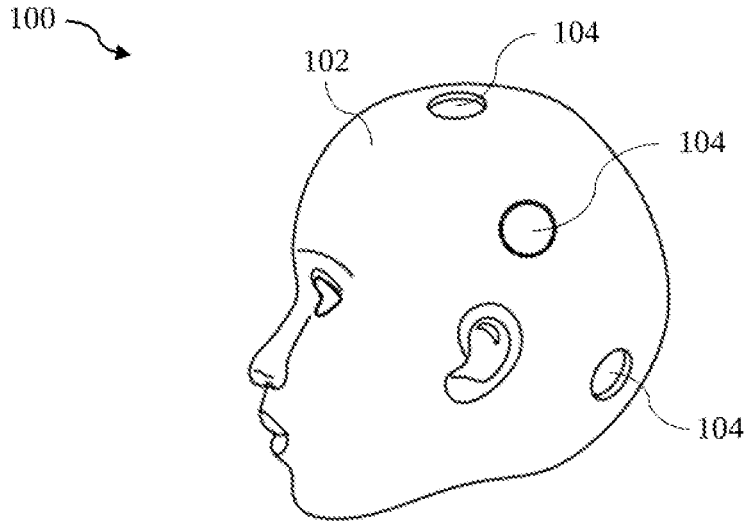
FIG. 1D illustrates a left side view of the doll head for the doll playset, according to an embodiment of the present disclosure.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Some embodiments of this disclosure, illustrating all its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dictates otherwise. Although any systems and methods similar or equivalent to those described herein can be used in the practice or testing of embodiments of the present disclosure, the preferred systems, and methods are now described.

Embodiments of the present disclosure will be described more fully hereinafter with reference to the accompanying drawings in which like numerals represent like elements throughout the several figures, and in which example embodiments are shown. Embodiments of the present disclosure may, however, be embodied in alternative forms and should not be construed as being limited to the embodiments set forth herein. The examples set forth herein are non-limiting examples and are merely examples among other possible examples.

FIGS. 1A-1D illustrate perspective views of a doll head for a doll playset 100, according to an embodiment of the present disclosure. FIGS. 1A-1D are described in conjunction with FIGS. 2-5.

The doll playset 100 may comprise the doll head 102 with a plurality of indentations 104 integrated within the doll head 102. In an aspect, the doll head 102 may be of any/various shapes or sizes to reflect various ethnicities. In one embodiment, the doll playset 100 may comprise a variety of dolls, such as but not limited to a play doll, a Barbie doll, an American Girl size doll, a vintage doll, themed dolls, etc. In another embodiment, the doll playset 100 may comprise different types of wig caps ranging from fixed to detachable.

Further, the plurality of indentations 104 may be integrated into an outer surface of the doll head 102. In an aspect, the plurality of indentations 104 may be located at a plurality of locations of the outer surface of the doll head 102. In one embodiment, the plurality of indentations 104 may be referred as a plurality of grooves. Further, the plurality of indentations 104 may be integrated at a front portion, a top portion, and a back portion of the outer surface of the doll head 102. In one exemplary embodiment, at least five indentations are integrated into the doll head 102. In other embodiments, the number of indentations may be more or less than five depending on, the size and shape of the doll head. In another embodiment, the shape of each of the plurality of indentations may be, but not limited to, triangular, heart-shaped, round, diamond, and pear-shaped. In another embodiment, at least ten indentations are integrated into the doll head 102 at various locations on the front side, the top side, and the backside. In one embodiment, the plurality of indentations 104 may be circular or rectangular in shape. In a further embodiment each of the plurality of indentations may be of different shape such as, but not limited to, a circular indentation, a rectangular indentation, a star-shaped indentation, a tetrahedron-shaped indentation, and the like. In an aspect, different shaped indentations allow the indentations to be more easily conforming with the shape of various shaped and sized doll heads 102, respectively. For example, a tetrahedron-shaped indentation and rectangular-shaped indentation may be more conforming and better suited for a pentagonal-shaped and square-shaped doll head, respectively.

Figure 2A:
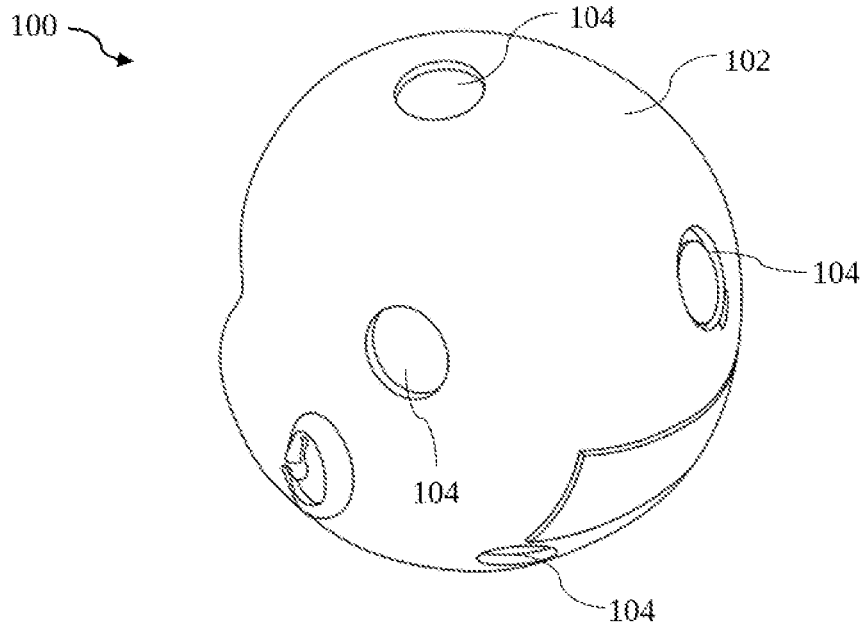
FIG. 2A illustrates a top perspective view of the doll head for the doll playset, according to an embodiment of the present disclosure.
Figure 2B:
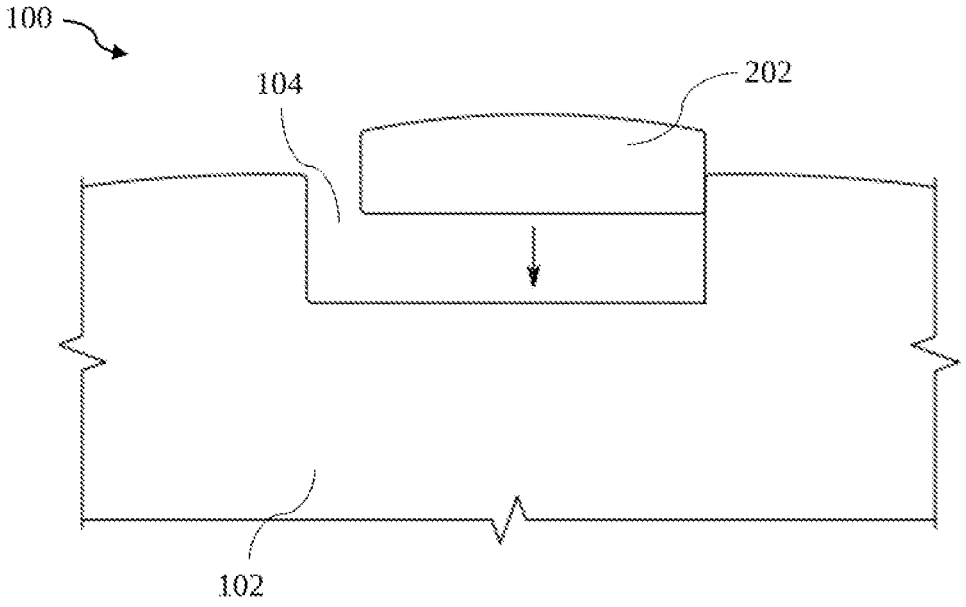
FIG. 2B illustrates a top section perspective view of the doll head with a magnet coupled to an indentation of the doll head, according to another embodiment of the present disclosure.
Figure 3A:
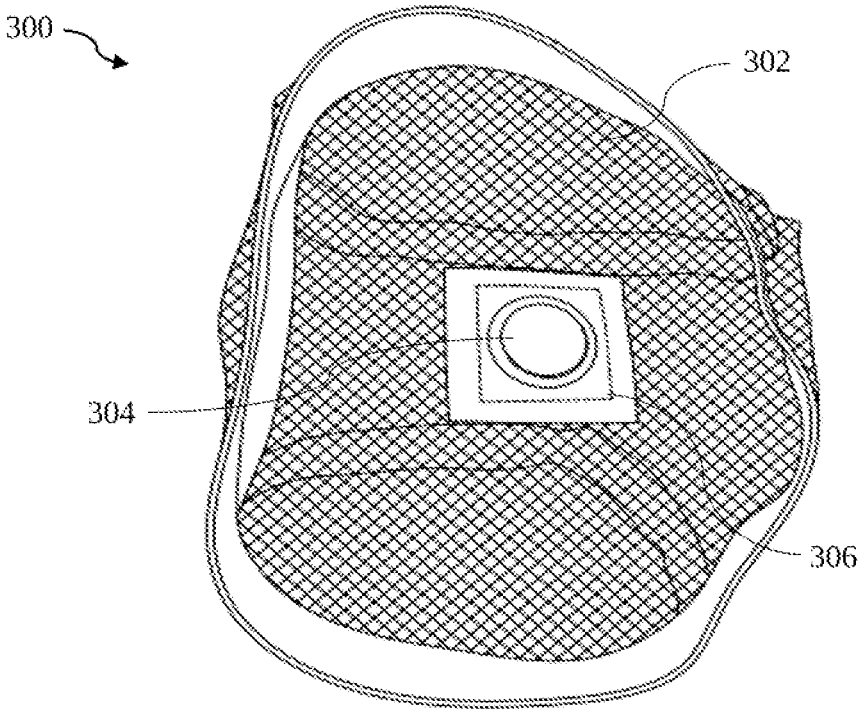
FIG. 3A illustrates a perspective view of a wig cap, according to another embodiment of the present disclosure.
Figure 3B:
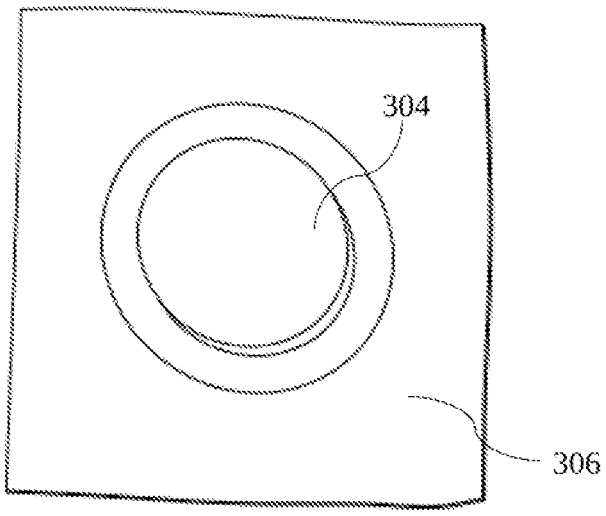
FIG. 3B illustrates a magnet enclosed in a plastic material, according to another embodiment of the present disclosure.
Figure 3C:
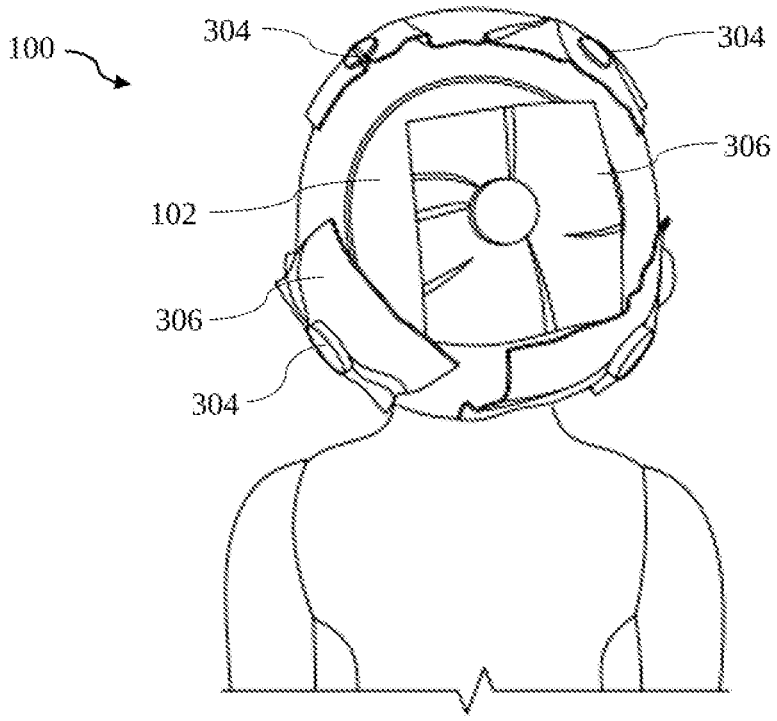
FIG. 3C illustrates a perspective view of a doll head with magnets, wherein the doll head is detachably coupled to the magnets enclosed in the plastic, according to another embodiment of the present disclosure.
Figure 4A:
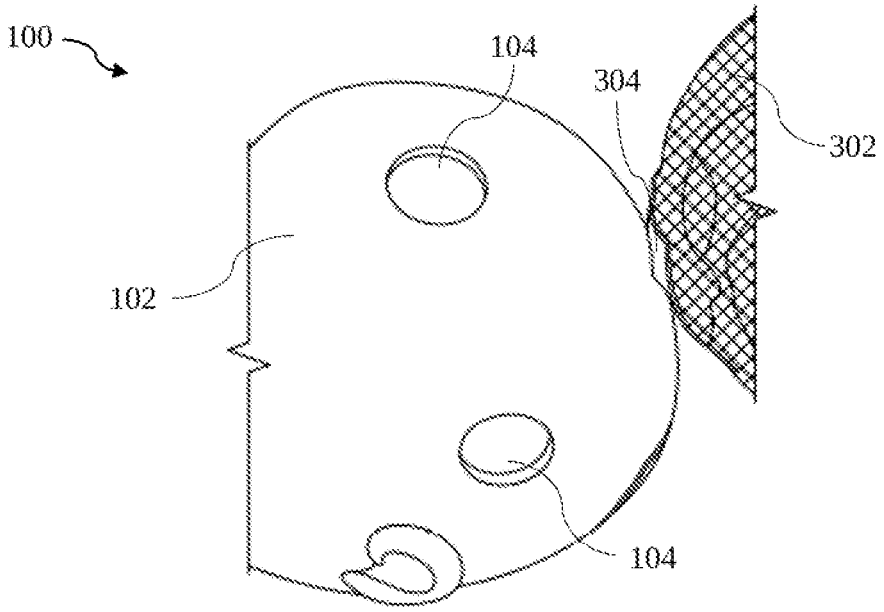
FIG. 4A illustrates a perspective view of the doll head detachably coupled with one of the second plurality of magnets of the wig cap, according to another embodiment of the present disclosure.
Figure 4B:
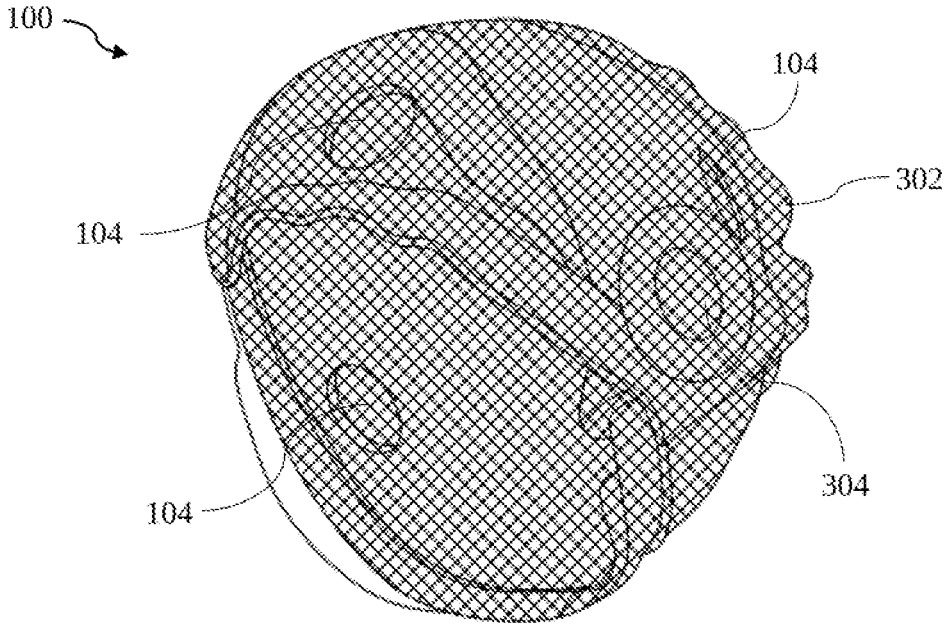
FIG. 4B illustrates a perspective view of the doll head detachably coupled with the wig cap, according to another embodiment of the present disclosure.

Referring to FIG. 2A and FIG. 2B, the doll playset 100 may comprise a first plurality of magnets 202 configured to be coupled with the plurality of indentations 104. It can be noted that the first plurality of magnets 202 may be placed flushed into the plurality of indentations 104. In one embodiment, the first plurality of magnets 202 may be coupled with the plurality of indentations 104 using various fastening means including, for example, glue, solder, screws, etc. In one embodiment, the fastening means may include but not limited to, use of adhesives, press-fit, or other attaching means. In an aspect, the first plurality of magnets 202 may be removably attached to the plurality of indentations 104. In one exemplary embodiment, five magnets are adhered on the doll head 102 into five corresponding indentations. In another exemplary embodiment, two magnets are adhered into two corresponding indentations at the front portion of the doll head 102, two magnets are adhered into two corresponding indentations at the back portion of the doll head 102, and one magnet is adhered into one corresponding indentation at the top portion of the doll head 102. Further, the first plurality of magnets 202 may be adhered into the plurality of indentations 104 using an adhesive or an adhering element. In one embodiment, height of the first plurality of magnets 202 may be same as depth of the one or more indentations 104. In one embodiment, the first plurality of magnets 202 and the adhesive may together form a magnet assembly.

Referring to FIGS. 3A-5, the doll playset 100 may comprise at least one wig cap 300 configured to be located and worn around the doll head 102. In one embodiment, the at least one wig cap 300 may be of different shape and size according to the structure of the doll head 102. Further, the at least one wig cap 300 may comprise a mesh structure 302 formed by a plurality of stretchable threads interwoven together. In one embodiment, the at least one wig cap 300 may be made of a material selected from a group of materials including a soft microfiber polyester, fabric, stretchable material, or a combination of fabrics, and the material is a washable material. It can be noted that the washable material enables the wig cap to be reused more frequently. Further, the at least one wig cap 300 may comprise a second plurality of magnets 304 housed within a plurality of pockets 306. Further, the plurality of pockets 306 is attached to the mesh structure 302 of the at least one wig cap 300, using traditional stitching. In one embodiment, the first plurality of magnets 202 and the second plurality of magnets 304 are of a flexible construction to allow them to be contoured and conforming with the skull of the doll head 102. In one embodiment, the second plurality of magnets 304 within the plurality of pockets 306 may be detachably attached with the first plurality of magnets 202 adhered into the plurality of indentations 104. In one embodiment, the plurality of pockets 306 may be made from a material selected from a group of materials of eco-friendly plastic, fabric, and the like. It can be noted that the plurality of pockets 306 eliminates the use of nickel-copper-nickel plating which is useful for, amongst other things, preventing rusting of the first plurality of magnets 202 and the second plurality of magnets 304. In an aspect, the first plurality of magnets 202 and the second plurality of magnets 304 may be, but not necessarily, of the same size. In one embodiment, the first plurality of magnets 202 and the second plurality of magnets 304 are housed in an eco-friendly plastic. The first plurality of magnets and the second plurality of magnets, in an exemplary embodiment of the present disclosure, are of the same shape. It can be noted that the first plurality of magnets 202 and the second plurality of magnets 304 may provide a secure, exacting placement or flexible placement of the wig cap 300 to accommodate different sized/shaped doll heads 102.

Further, the first plurality of magnets 202 and the second plurality of magnets 304 may be detached from each other when the at least one wig cap 300 may be removed from the doll head 102. In one embodiment, each of the plurality of pockets 306 may be provided with an opening to incorporate each of the second plurality of magnets 304. In one embodiment, each of the first plurality of magnets 202 and the second plurality of magnets 304 may comprise a magnet, such as but not limited to, Neodymium 52 (N52) magnets, N40, N45, and alike. In one embodiment, the first plurality of magnets 202 and the second plurality of magnets 304 may allow a strict and flexible placement of the at least one wig cap 300 to accommodate different shapes and different sizes of a doll head 102. In yet another embodiment, the at least one wig cap 300 may also be referred to as a magnetic wig cap due to bonding of the second plurality of magnets 304 enclosed within the plurality of pockets 306, with the first plurality of magnets 202 adhered into the plurality of indentations 104. It is envisioned that in accordance with this aspect, the first and/or second plurality of magnets 202 and 304, respectively, may be similarly shaped as the respective plurality of indentations 104.

In one embodiment, the first plurality of magnets 202 and the second plurality of magnets 304 may have the same structure, such as but not limited to, a circular, annular, square, or rectangular structure. In one exemplary embodiment, the first plurality of magnets 202 and the second plurality of magnets 304 have a thickness of 0.5 inches. In another exemplary embodiment, the first plurality of magnets 202 and the second plurality of magnets 304 have a diameter of 0.5 inches.

Figure 5:
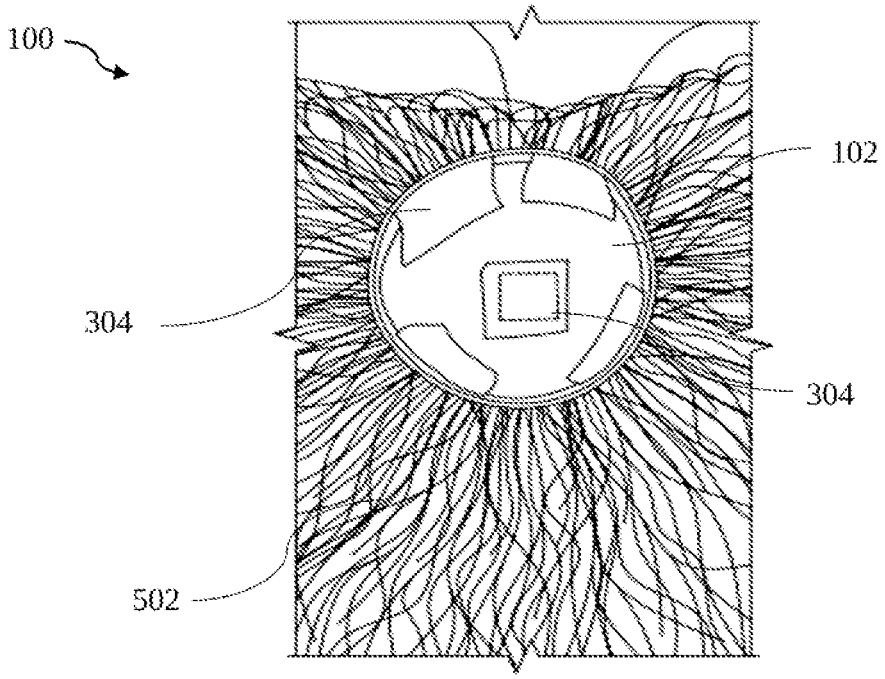
FIG. 5 illustrates an exemplary embodiment showing the doll head detachably coupled with the second plurality of magnets of the wig cap, according to another embodiment of the present disclosure.

In one embodiment, the at least one wig cap 300 with the mesh structure 302 may be designed to cover the doll head 102, from the forehead to rear portion of doll head 102. In one exemplary embodiment, different colors of hair may be attached to the at least one wig cap 300 as shown in FIG. 5. Further, as shown in FIG. 5, a plurality of hair filaments 502 may be attached individually to or embedded in the at least one wig cap 300. In an aspect, a lesser amount of hair filaments 502 may be required to manufacture the at least one wig cap 300 in comparison to traditional doll wigs. In this regard, manufacturing costs may be reduced while also providing full hair coverage of the doll head. In another embodiment, the plurality of hair filaments 502 may also be styled by the user either separate or when attached to the doll head 102. Further, the plurality of hair filaments 502 may be attached to an edge line underside the at least one wig cap 300. In a further embodiment, the attachment of the plurality of hair filaments 502 may be referred to as under-looping. In an aspect, the under-looped plurality of hair filaments 502 may help to conceal the edge line of the at least one wig cap 300, thereby providing a more realistic appearance.

In one embodiment, the density of the plurality of hair filaments 502 may be easily controlled since each hair may be individually attached to the at least one wig cap 300. In one exemplary embodiment, to style the at least one wig cap 300 of the doll playset 100 for an infant with thin hair or an adult with balding, a low hair density may be used to create different appearances. In another embodiment, a varying hair density may be used to achieve a thicker appearance in some areas in the at least one wig cap 300 and balding in others such as at the crown of the doll head 102, more typically seen with adult males. In an aspect, the hair may be synthetic nylon or polyester fine threads, or may be the real hair of human or animal. It is envisioned that other materials and fibers may be used as hair for the doll wig. Further, the at least one wig cap 300 may allow placement of the plurality of hair filaments 502 depending on the requirements of the user. In another aspect, the color of the plurality of hair filaments 502 may vary according to the color of the face of doll playset 100, such as for brown doll playset 100, black hair or brown hair may be suitable, etc.

In an exemplary embodiment, the size of the at least one wig cap 300 may typically vary between approximately 6 inches to 18 inches. In a further embodiment of the present disclosure, that the doll maker determines the size of the wig cap 300 by measuring around the forehead, behind the ears and around the nape of the neck. In another embodiment, the doll head 102 may be made from a material selected from a group of materials of porcelain, translucent polymer, polyvinylchloride (PVC). In yet another embodiment, the doll head 102 may be made of porcelain.

In one alternate embodiment, the doll head 102 of the doll playset 100 may be replaceable according to the color and texture of the doll playset 100 required. In an aspect, embodiments of the present disclosure allow the doll playset 100 to be configured in various forms of ethnicity allowing, for instance, selection/preference for different face contours of a doll, such as, but not limited to, an angular face, square-shaped face, round-shaped face, and the like. Depending upon the requirements of the doll playset 100 a variety of doll heads 102 may be produced and provided. In another embodiment, to achieve multi-ethnic variability, the color requirement of the doll head 102 may also play an important role in the selection process of the doll playset 100. Some infants, children, and adults may prefer brown color faces; some may have black/African or white/European preferences. Therefore, different colors and hues of doll heads 102 may be manufactured keeping in mind the preferences of the users. Another aspect of the selection of the doll playset 100 may include, but not limited to, the color of the hair filaments 502 of the wig cap 300. In one embodiment, the color of the hair filaments 502 may comprise, but not limited to, black, brown, red, white, blue, green, blonde, etc. The present doll playset 100 provides a replaceable wig cap 300 through which different colors of hair filaments 502 can be attached to the wig cap 300. In an aspect, the replacement of the wig cap 300 is enabled by easily pulling off the wig cap 300 which detaches the second plurality of magnets 304 within the plurality of pockets 306 of the wig cap 300, from the first plurality of magnets 202 adhered to the plurality of indentations 104. Further, the doll playset 100 may be provided with a variety of hair filaments and wig caps for children/users to attach or detach the wig cap according to their choice.

It will be apparent to one skilled in the art that the above-mentioned components of the doll playset 100 have been provided only for illustration purposes. Further, embodiments of the present invention relate to an article of a play doll that, upon installation of the doll playset 100 turns into a doll playset 100 having an aesthetic appearance for children or adults to play with it, without departing from the scope of the disclosure.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

LIST OF ELEMENTS

100 Doll Playset
102 Doll Head
104 Plurality of Indentations
202 First Plurality of Magnets
300 Wig Cap
302 Mesh Structure
304 Second Plurality of Magnets
306 Plurality of Pockets
502 Plurality of Hair Filaments

What is claimed is:

1. A doll playset comprising:

a doll head having:

a plurality of indentations located at a plurality of locations on the doll head; and a first plurality of magnets coupled to each of the plurality of indentations; and at least one wig cap having a second plurality of magnets, wherein the at least one wig cap is detachably coupled to the doll head by coupling the second plurality of magnets with the first plurality of magnets.

2. The doll playset of claim 1, wherein each of the plurality of indentations is circular or rectangular in shape.

3. The doll playset of claim 1, wherein the plurality of indentations is located on at least one of a front portion of the doll head, a back portion of the doll head, and a top portion of the doll head.

4. The doll playset of claim 1, wherein the first plurality of magnets is coupled on an outer surface of the doll head.

5. The doll playset of claim 4, wherein the first plurality of magnets is coupled on the outer surface of the doll head using an adhesive or an adhering element.

6. The doll playset of claim 1, wherein the first plurality of magnets and the second plurality of magnets are at least one of neodymium52 (N52) magnets, N40 magnets, and/or N45 magnets.

7. The doll playset of claim 6, wherein the first plurality of magnets and the second plurality of magnets are 0.5 inch in thickness.

8. The doll playset of claim 6, wherein the first plurality of magnets and the second plurality of magnets are 0.5 inch in diameter.

9. The doll playset of claim 6, wherein the first plurality of magnets and the second plurality of magnets are flexible type and/or shaped to accommodate different size or shape of doll head.

10. The doll playset of claim 1, wherein the first plurality of magnets and the second plurality of magnets are house in an eco-friendly plastic.

11. The doll playset of claim 1, wherein height of the first plurality of magnets is same as depth of the one or more indentations.

12. The doll playset of claim 1, wherein the at least one wig cap is made of a material selected from a group of materials including a soft micro fiber polyester, fabric, stretchable material, or a combination of fabrics, and the material is a washable material.

13. The doll playset of claim 1, wherein the at least one wig cap covers the doll head.

14. The doll playset of claim 1, wherein the first plurality of magnets and the second plurality of magnets are of same shape.

15. A doll playset comprising:

a doll head having:

a plurality of indentations located at a plurality of locations on the doll head; and a first plurality of magnets coupled to each of the plurality of indentations; and a wig cap having:

a plurality of pockets; and a second plurality of magnets inserted inside the plurality of pockets, wherein the wig cap is detachably coupled to the doll head by coupling the second plurality of magnets with the first plurality of magnets.

16. The doll playset of claim 15, wherein the first plurality of magnets is coupled on an outer portion of the doll head.

17. The doll playset of claim 16, wherein the first plurality of magnets is coupled on the outer portion of the doll head using an adhesive or an adhering element.

18. The doll playset of claim 17, wherein the wig cap is made of a material selected from a group of materials including a soft micro fiber polyester, fabric, stretchable material, or a combination of fabrics, and the material is a washable material.

19. The doll playset of claim 15, wherein the first plurality of magnets and the second plurality of magnets are of same shape.

* * * * *